US012697559B2

(12) United States Patent
Jeon

(10) Patent No.: US 12,697,559 B2
(45) Date of Patent: Aug. 4, 2026

(54) GAS INJECTION DEVICE AND BALLOON

(71) Applicant: Rising Entertainment Co., Ltd., Tokyo (JP)

(72) Inventor: Juntak Jeon, Tokyo (JP)

(73) Assignee: Rising Entertainment Co., Ltd., Tokyo (JP)

( * ) Notice: Subject to any disclaimer, the term of this patent is extended or adjusted under 35 U.S.C. 154(b) by 94 days.

(21) Appl. No.: 18/697,724

(22) PCT Filed: Oct. 5, 2021

(86) PCT No.: PCT/JP2021/036852
§ 371 (c)(1),
(2) Date: Apr. 1, 2024

(87) PCT Pub. No.: WO2023/058122
PCT Pub. Date: Apr. 13, 2023

(65) Prior Publication Data
US 2024/0399267 A1 Dec. 5, 2024

(51) Int. Cl.
*A63H 27/10* (2006.01)

(52) U.S. Cl.
CPC ..... *A63H 27/10* (2013.01)

(58) Field of Classification Search
CPC ..... A63H 27/10; A63H 2027/1008–1083
See application file for complete search history.

(56) References Cited

U.S. PATENT DOCUMENTS 3,380,490 A * 4/1968 Ellenberg ..... G07F 11/58 141/181
3,536,110 A * 10/1970 Elmer ..... G07F 13/02 141/181
3,561,579 A * 2/1971 Allison ..... G07F 11/72 221/199
3,670,860 A * 6/1972 Allison ..... G07F 11/44 194/219

(Continued)

FOREIGN PATENT DOCUMENTS

WO WO 2016/125778 A1 8/2016

OTHER PUBLICATIONS

International Search Report issued in PCT Application No. PCT/JP2021/036852, JPO, Japan, Apr. 13, 2023, 8 pages.

*Primary Examiner* — Michael D Dennis
*Assistant Examiner* — Matthew B Stanczak
(74) *Attorney, Agent, or Firm* — ASLAN LAW, P.C.

(57) ABSTRACT

A gas injection apparatus 100 comprises a nozzle for being inserted into the balloon valve and injecting gas into the balloon body, a valve mechanism for opening and closing a gas flow path to the nozzle, a drive mechanism for moving the nozzle forward and backward, a balloon case placing section 120 having a flat bottom surface and capable of fixing an open end of the balloon valve in a direction opposite to the forward movement direction of the nozzle by making a balloon case in which the balloon body is housed placed with fixing the balloon valve; and a control unit for controlling the drive mechanism and the valve mechanism, wherein the control unit moves the nozzle forward in response to a start instruction, inserts the nozzle into the balloon valve to tightly contact with each other without clearance and injects gas into the balloon body.

4 Claims, 10 Drawing Sheets

(56) References Cited

U.S. PATENT DOCUMENTS 3,911,974 A * 10/1975 Kuykendall ..... F17C 7/00 141/94
3,994,324 A * 11/1976 Zeyra ..... A63H 27/10 222/639
4,088,161 A * 5/1978 Ikemoto ..... G07F 17/06 141/176
5,054,273 A * 10/1991 Schmitt ..... A63H 27/10 53/577
5,067,301 A * 11/1991 Shore ..... A63H 27/10 53/88
5,083,771 A * 1/1992 Tyner ..... A63H 27/10 116/DIG. 9
5,370,161 A * 12/1994 Shafer ..... A63H 27/10 141/369
5,399,122 A * 3/1995 Slater ..... G05D 7/0146 472/51
5,573,437 A * 11/1996 Van Dyke ..... B42D 15/045 446/79
5,651,402 A * 7/1997 McCaul ..... A63H 27/10 141/97
5,653,272 A * 8/1997 McCaul ..... A63H 27/10 141/46
6,478,057 B1 * 11/2002 Bearss ..... A63H 27/10 141/114
6,634,394 B1 * 10/2003 Nelson ..... A63H 27/10 141/97
9,555,336 B2 * 1/2017 Walz ..... A63H 27/10
10,699,513 B2 * 6/2020 Jeon ..... G07F 11/00
12,472,443 B1 * 11/2025 Amar ..... A63H 27/10
2001/0042573 A1 * 11/2001 Komaba ..... F17C 3/00 141/114
2005/0076968 A1 * 4/2005 Ratermann ..... A63H 27/10 141/114
2007/0084878 A1 * 4/2007 Handa ..... A63H 27/10 221/303
2007/0249259 A1 * 10/2007 Pham ..... A63H 33/22 446/224
2008/0121309 A1 * 5/2008 Boise ..... A63H 27/10 141/313
2010/0065151 A1 * 3/2010 Nelson ..... A63H 27/10 141/114
2012/0037269 A1 * 2/2012 Alder ..... B32B 27/00 141/98
2015/0283473 A1 * 10/2015 Frazier ..... A63H 27/10 141/96
2016/0101367 A1 * 4/2016 Walz ..... A63H 27/10 141/105
2018/0025574 A1 * 1/2018 Jeon ..... G07F 17/32 446/220
2021/0129037 A1 * 5/2021 Nelson ..... A63H 27/10
2024/0102769 A1 * 3/2024 Ganor ..... F42B 6/00
2024/0399267 A1 * 12/2024 Jeon ..... A63H 27/10
2025/0135296 A1 * 5/2025 Zhang ..... A63B 43/00
2026/0079507 A1 * 3/2026 Lindell ..... G05D 11/001

* cited by examiner

GAS INJECTION DEVICE AND BALLOON

RELATED ART

Field of the Invention

The present invention relates to a gas injection apparatus which are mainly installed in facilities such as a theme park, an amusement park, a shopping mall, and a game center and can inject gas into the balloon and a balloon.

Description of the Related Art

Conventionally, there has been proposed a balloon vending machine which is installed at a place where a large number of children go to play and sells a balloon (Patent Document 1). In the balloon vending machine described in Patent Document 1, the purchaser can see a state in which the balloon is gradually expanded by injecting helium gas or the like into the purchased balloon.

In the balloon vending machine disclosed in Patent Document 1, a balloon case inserting port having an inverted T shape is formed through a table plate of the balloon vending machine, and the balloon is inserted into the port by a user. Then, a nozzle is inserted into the fixed balloon valve, and helium gas or the like is injected into the balloon from a gas bomb built in the balloon vending machine. The user can see the balloon expanding gradually.

Patent Document

Patent Document 1: WO2016/125778

However, whether or not the balloon is securely inserted and fixed depends on the manner of insertion by the user. In some cases, problems may arise due to insufficient fixation of the balloon or incorrect orientation of the open end of the balloon valve.

The present invention has been made in view of such circumstances, and an object of the present invention is to provide a gas injection apparatus and a balloon which are less likely to have a defect depending on how the balloon is installed in the apparatus.

SUMMARY OF THE INVENTION

In order to achieve the above object, a gas injection apparatus according to the present invention is a gas injection apparatus for injecting gas into a balloon body from a balloon valve connected to a gas injection pipe of the balloon body comprising a nozzle for being inserted into the balloon valve and injecting gas into the balloon body, a valve mechanism for opening and closing a gas flow path to the nozzle, a drive mechanism for moving the nozzle forward and backward, a balloon case placing section having a flat bottom surface and capable of fixing an open end of the balloon valve in a direction opposite to the forward movement direction of the nozzle by making a balloon case in which the balloon body is housed placed with fixing the balloon valve; and a control unit for controlling the drive mechanism and the valve mechanism, wherein the control unit moves the nozzle forward in response to a start instruction, inserts the nozzle into the balloon valve to tightly contact with each other without clearance and injects gas into the balloon body.

DETAILED DESCRIPTION OF THE INVENTION

Next, embodiments of the present invention are described with reference to the drawings.

(Appearance of Gas Injection Apparatus)

Figure 1:
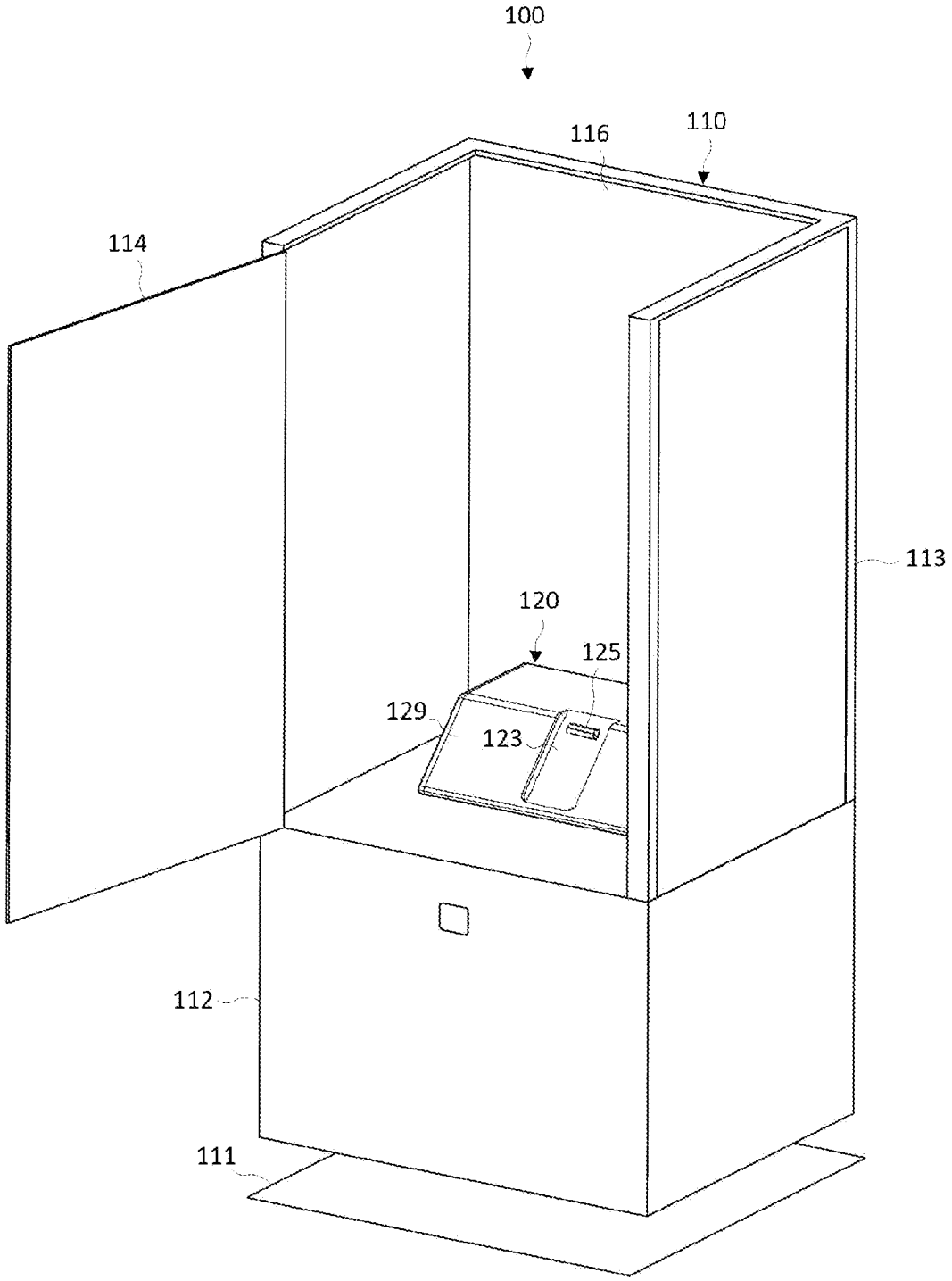
FIG. 1 is a perspective view showing an appearance of the entire gas injection apparatus.

FIG. 1 is a perspective view showing an appearance of the entire gas injection apparatus 100. The entire gas injection apparatus 100 injects gas into a balloon body from a balloon valve connected to the gas injection pipe of the balloon body. As shown in FIG. 1, the housing 110 of the gas injection apparatus 100 comprises a base 111, a mechanism housing section 112, and a gas injection chamber 113.

The base 111 supports the mechanism housing section 112 and the gas injection chamber 113 and can adjust their posture with respect to the floor surface. The mechanism housing section 112 houses the entire gas flow path and the drive mechanism therein. The gas injection chamber 113 is configured of a door 114 and walls 116 with flat plate shapes parallel to the vertical direction, the ceiling is open, and the inside and the outside for injecting gas into the balloon are partitioned. A display monitor may be provided on the inner wall 116. The display monitor can display guidance such as how to place the balloon.

The door 114 is a transparent plate-like body and is pivotably connected to an end part of the wall 116 by a hinge. The door 114 covers the front surface of the gas injection apparatus 100, and the user can view the inside of the apparatus from the outside. The door 114 may be formed of, for example, an acrylic plate or glass. The door 114 may be motorized or manual.

The balloon case placing section 120 is provided on the outer surface of the mechanism housing section 112 inside the gas injection chamber 113. The balloon case placing section 120 has a flat bottom surface 123 and is configured to be able to place the balloon case on the bottom surface 123. When the balloon case is placed, the outer main surface of the balloon case contacts the bottom surface 123, and the open end of the balloon valve can be fixed in a direction opposite to the forward movement of the nozzle. As a result, it is possible to reduce the variation in the placing state of the balloon by the user and reduce the occurrence rate of the defect at the time of gas injection.

The balloon case placing section 120 has an inclined stage 129 facing the user side, and the bottom surface 123 thereof is recessed from the inclined stage 129. The depression from the inclined stage 129 forms a recessed part for fitting the balloon case. The inclined stage 129 and the bottom surface 123 are preferably inclined at an angle of 10° to 45° with respect to the horizontal plane, and more preferably inclined at an angle of 15° to 25°. As a result, the balloon can be easily placed, and the drive mechanism and the like can be sufficiently housed in the mechanism housing section 112, so that the space can be efficiently utilized. The inclined stage 129 may display a guide for the user, a start button using a touch panel, or the like. The start button may be a physical press switch.

The bottom surface 123 of the balloon case placing section 120 is preferably parallel to the forward movement direction of the nozzle. This makes it easier to align the insertion position of the nozzle with the central of the balloon valve. The balloon body is stored in the balloon case to be placed while the balloon valve is fixed. The placed balloon case is fixed with the open end of the balloon valve facing the forward movement direction of the nozzle.

The balloon case placing section 120 has a projection part 125 that is fitted into a finger insertion part of the balloon case. The projection part 125 is formed in an elongated columnar shape and is inserted into a hole of the finger insertion part to fix the placed balloon case. The projection part 125 preferably has a cross section having the same shape as the hole of the finger insertion part, and is formed in, for example, a rounded rectangular prism. Since the balloon case is fixed, the balloon valve can be fixed to a force applied toward the balloon body by the nozzle inserted into the balloon valve. That is, misalignment can be prevented when the nozzle is inserted into the balloon valve. The user can open the door 114 to place the balloon inside the gas injection chamber 113 and remove the balloon after expansion of the balloon body.

(Functional Configuration of Gas Injection Apparatus)

Figure 2:
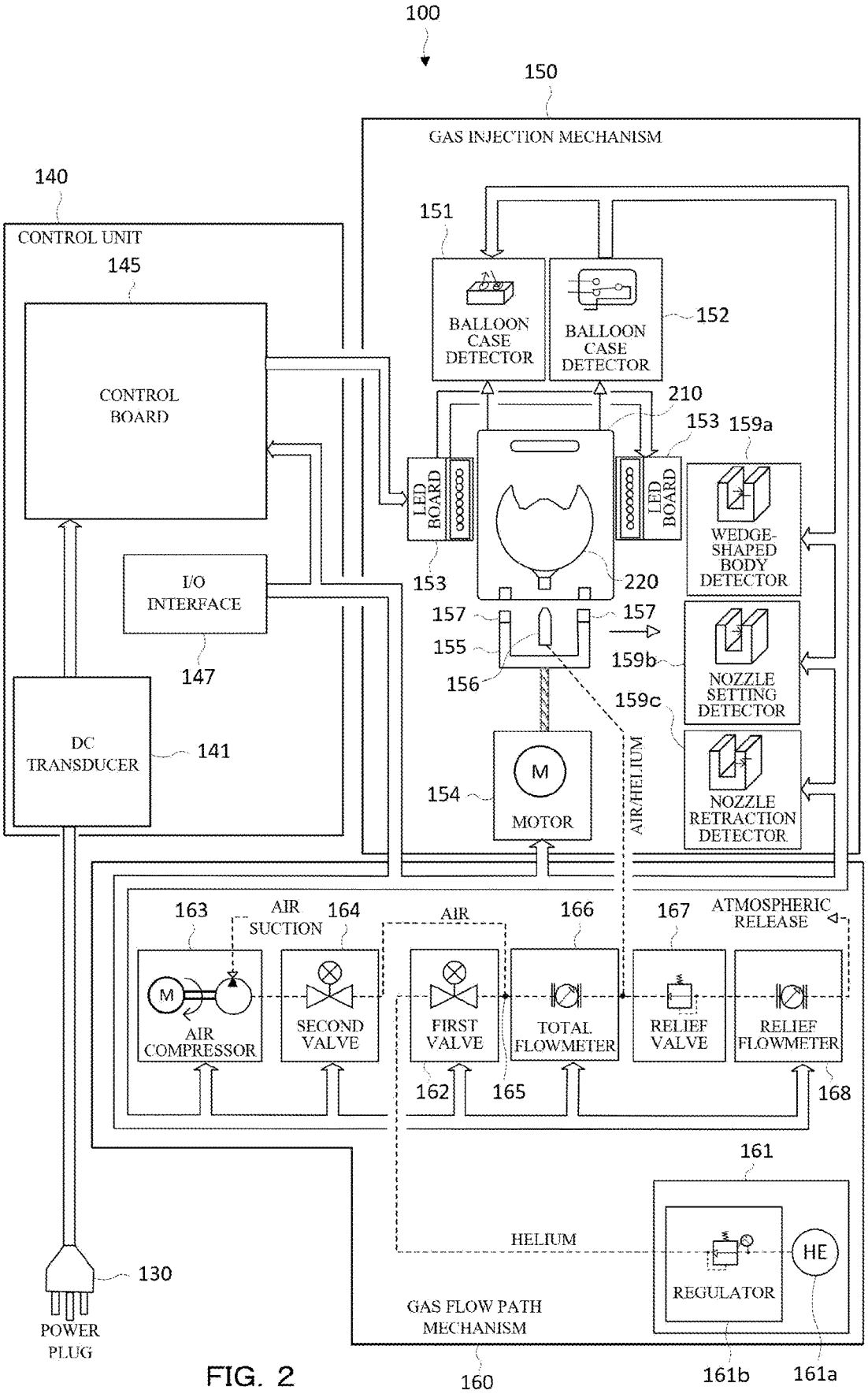
FIG. 2 is a block diagram showing the functional configuration of the gas injection apparatus.

FIG. 2 is a block diagram showing a functional configuration of the gas injection apparatus 100. The gas injection apparatus 100 comprises a power plug 130, a control unit 140, a gas injection mechanism 150, and a gas flow path mechanism 160. The power plug 130 is connected to AC power supply and supplies a current from AC power supply to the control unit 140.

The control unit 140 comprises a DC transducer 141, a control board 145, and an input/output interface 147. The DC transducer 141 converts AC current into a DC current. The control board 145 comprises a CPU, memories, and peripheral connecting parts, and controls the respective parts in accordance with on/off of the respective switches, user operation, and the like. The control unit 140 controls the drive mechanism and the valve mechanism.

For example, the control board 145 controls the movement of the nozzle 156 and the injection of gas into the balloon body. Upon receiving the start instruction, the control board 145 advances the nozzle 156 toward the balloon valve, stops the movement and starts the injection of gas into the balloon body when it detects that the mobile body has moved to a predetermined position. The forward movement direction of the nozzle 156 is a direction parallel to the gas passing direction of the balloon valve. In this way, the nozzle is inserted into the balloon valve and tightly contacts with the balloon without clearance, and the gas is injected into the balloon body.

The control board 145 also controls the injection of gas into the balloon. For example, when a predetermined time has elapsed, the gas path is switched, and when the gas pressure becomes constant, the gas injection is ended. It is preferable that the first gas is injected into the balloon body until a predetermined time by opening and closing the first and second valves, and the second gas is injected into the balloon body after the injection of the first gas until a predetermined pressure is achieved. Thus, by injecting the first gas having a high pressure up to a predetermined time and then injecting the second gas little by little until a predetermined pressure is achieved, it is possible to inject the gas efficiently.

The control board 145 controls LED board 153. The control board 145 performs input/output such as reception of pressing of a gas injection start button and guidance display to a user via the input/output interface 147.

The gas injection apparatus 150 comprises balloon case detectors 151 and 152, a LED board 153, a motor 154, a mobile body 155, a nozzle 156, wedge-shaped bodies 157, a wedge-shaped body detector 159*a*, a nozzle setting detector 159*b*, and a nozzle retraction detector 159*c*.

The balloon case detector 151 detects the balloon case placed by the photo reflector. The balloon case detector 152 is a switch-type detector and detects the balloon case when the balloon case is placed, and a switch physically get turned on. Both the balloon case detector 151 and the balloon case detector 152 can detect whether or not the balloon case 210 tightly contacts with the bottom surface 123 of the placing section. LED board 153 turns on and off LED for visual effect.

The motor 154 moves the mobile body 155 forward and backward in a specific direction by a slide mechanism or the like that transmits a driving force using a rotary shaft. For example, a rotary shaft in which a screw is formed along the nozzle moving direction is provided, and the mobile body 155 is movably attached to the rotary shaft. When the rotation of the motor 154 is transmitted to the rotary shaft and the rotary shaft is rotated forward, the mobile body 155 moves in a direction approaching the balloon valve, and when the rotary shaft is rotated backward, the mobile body 155 moves in a direction away from the gas inlet of the balloon. A nozzle 156 and a pair of wedge-shaped bodies 157 are installed to the mobile body 155, and the nozzle 156 and the wedge-shaped bodies 157 also move in conjunction with the movement of the mobile body 155.

The nozzle 156 is plugged into the balloon valve to inject gas into the balloon body. The wedge-shaped bodies 157 are preferably provided in pairs at equal intervals and are inserted into the positions of the openings of the balloon case to unfold the balloon case. Detailed configurations of the nozzle 156 and the wedge-shaped body 157 are described later.

The wedge-shaped body detector 159*a* detects the wedge-shaped body 157 that has advanced to a predetermined position. This makes it possible to confirm whether the wedge-shaped bodies 157 have reached the position where the balloon case 210 is certainly opened. The nozzle setting detector 159*b* detects the nozzle 156 advanced to a position of the insertion into the balloon valve. The nozzle retraction detector 159*c* detects the nozzle 156 that has been retracted to a predetermined position (standby home position) after the gas injection is completed. It is preferable that the wedge-shaped body detector 159*a*, the nozzle setting detector 159*b*, and the nozzle retraction detector 159*c* use an optical sensor that detects a change in the amount of light shielded by the light receiving unit and obtains an output-signal.

The gas flow path mechanism 160 comprises a first gas source 161, a first valve 162, a second gas source 163, a second valve 164, a total flowmeter 166, a relief valve 167 and a relief flowmeter 168.

The first gas source 161 is a gas source that supplies the first gas at a predetermined pressure, and comprises, for example, a gas bomb 161*a* and a regulator 161*b*. The gas bomb 161*a* is filled with a gas lighter than air such as helium gas. The first valve 162 is controlled by the control unit 140 and opens and closes a flow path of the first gas to the flow path integrating section 165 connected to the nozzle 156.

The second gas source 163 is a gas source that supplies the second gas at a predetermined pressure and is an air compressor that sucks the atmosphere and feeds it to the flow path at a constant pressure. The second valve 164 is controlled by the control unit 140 and opens and closes a flow path of the second gas to the flow path integrating section 165 connected to the nozzle 156.

Preferably, the second gas has a lower pressure than the first gas. Thus, by controlling the injection of the second gas after the injection of the first gas, the total amount of gas injected into the balloon body can be adjusted efficiently. The first valve 162 and the second valve 164 constitute a valve mechanism.

The total flowmeter 166 detects the total flow rate of the gas flowing from the flow path integrating section 165 to the nozzle 156. The relief valve 167 is set to open when the gas pressure exceeds a threshold value that is greater than or equal to the pressure of the expanded balloon body. The relief flowmeter 168 detects the flow rate of the leakage by the relief valve 167. The control unit 140 determines whether or not the balloon body has been expanded at the detected flow rate of the leakage. Although the amount of gas injected into the balloon body is appropriate by the above-described mechanism, the control unit 140 may further monitor the total flow rate and the internal pressure of the balloon body to control to avoid insufficient or excessive gas injection.

(Balloon Case Placing Section and Drive Mechanism)

Figure 3:
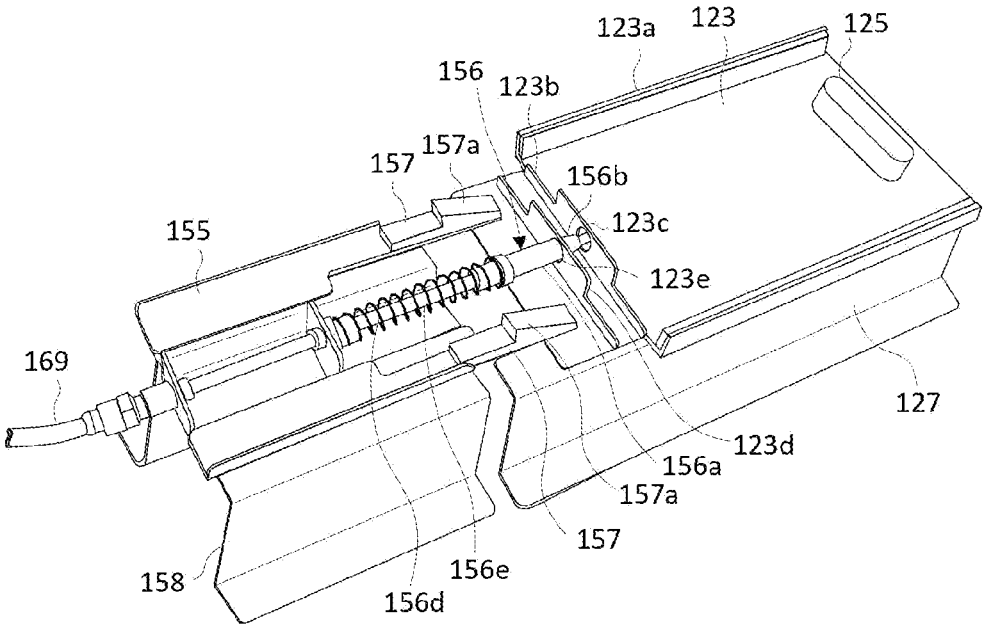
FIG. 3 is a perspective view of the gas injection mechanism.

FIG. 3 is a perspective view of the gas injection mechanism 150. The bottom surface 123 of the balloon case placing section is fixed on the placing base part 127 and is surrounded by the side walls 123*a* and the front wall 123*b*. The front wall 123*b* comes into contact with the unfold openings and the valve insertion part when the balloon case is placed. A circular hole 123*c* is formed in the central of the front wall 123*b*.

A guide wall 123*d* is further provided on the front side of the front wall 123*b*, and a hole 123*e* is formed in the guide wall 123*d*. When the nozzle 156 is advanced, the nozzle tip part 156*a* passes through the hole 123*e* and the hole 123*c* and is inserted into the balloon valve without being deflected.

The mobile body 155 is slidably fixed on the mobile body base part 158. The mobile body 155 slides forward and backward for the balloon case placing section by a drive mechanism including a motor 154 and a rotary shaft. The nozzle 156 and the pair of wedge-shaped bodies 157 are fixed to the mobile body 155.

The wedge-shaped bodies 157 are movable in conjunction with the nozzle 156 by the drive mechanism. As described later, in the balloon case, the unfold openings are formed by slots provided at opposite positions each of the first case piece and the second case piece in a closed state.

The wedge-shaped body tip part 157*a* is provided with an inclined surface that conforms to the position and geometry of the unfold opening. When the balloon case is closed, the wedge-shaped bodies 157 are inserted into the unfold openings formed by the slots provided at the respective opposed positions of the pair of case pieces, whereby the inclined surface of the wedge-shaped body tip parts 157*a* separate the first case piece from the second case piece, and the balloon case is unfolded. As a result, the balloon case can be opened before the gas injection, thereby reducing the trouble at the time of the gas injection and stably performing the gas injection.

The nozzle 156 comprises a nozzle tip part 156*a*, a spring 156*d*, and a straight-pipe 156*e*. The straight pipe 156*e* is connected to the gas flow path from the flow path integrating section 165. The straight-pipe 156*e* is preferably metallic. An airtight nozzle tip part 156*a* is slidably connected to one end of the straight pipe 156*e*.

The slide of the nozzle tip part 156*a* in a direction to the balloon valve is preferably suppressed by the spring 156*d*. Accordingly, it is possible to restrict the pressing force to a certain value or less by relaxing the pressing force in the slidable structural while applying the pressing force by the spring 156*d* to the nozzle tip part 156*a* inserted into the balloon valve. The spring 156*d* may be replaced with other elastic member that provides an elastic force.

The end of the nozzle tip part 156*a* is preferably formed of a rubbery body having a convergent slope 156*b*. Thus, the nozzle tip part 156*a* tightly contacts with the opening of the balloon valve formed in a tubular shape, thereby sealing the gas flow path. The rubbery body is, for example, made of a material typified by silicone rubber. Gas leakage is not caused by this tight contact. The nozzle tip part 156*a* is preferably formed in a convergent frustoconical shape with respect to the opening of the tubular balloon valve.

A gas hose 169 is connected to the other end of the straight pipe 156*e*. The gas hose 169 has branches at the flow path integrating section 165, one of which is connected to the first valve 162, and the other of which is connected to the second valve 164.

(Balloon Vending Machine)

Note that the gas injection apparatus 100 may be provided with a balloon stock section for stocking the balloons 200 to be sold and may be used as a balloon vending machine. For example, a balloon discharge port may be formed as an opening in a lower front surface of the balloon stock section, and a charge slot may be formed in a front surface of the apparatus main body. The balloon vending machine may be configured such that the balloon stored in the balloon stock section is discharged to the balloon discharge port when the balloon purchase fee is input to the charge slot and the selection determination button is pressed.

(Configuration of Balloon)

Figure 4:
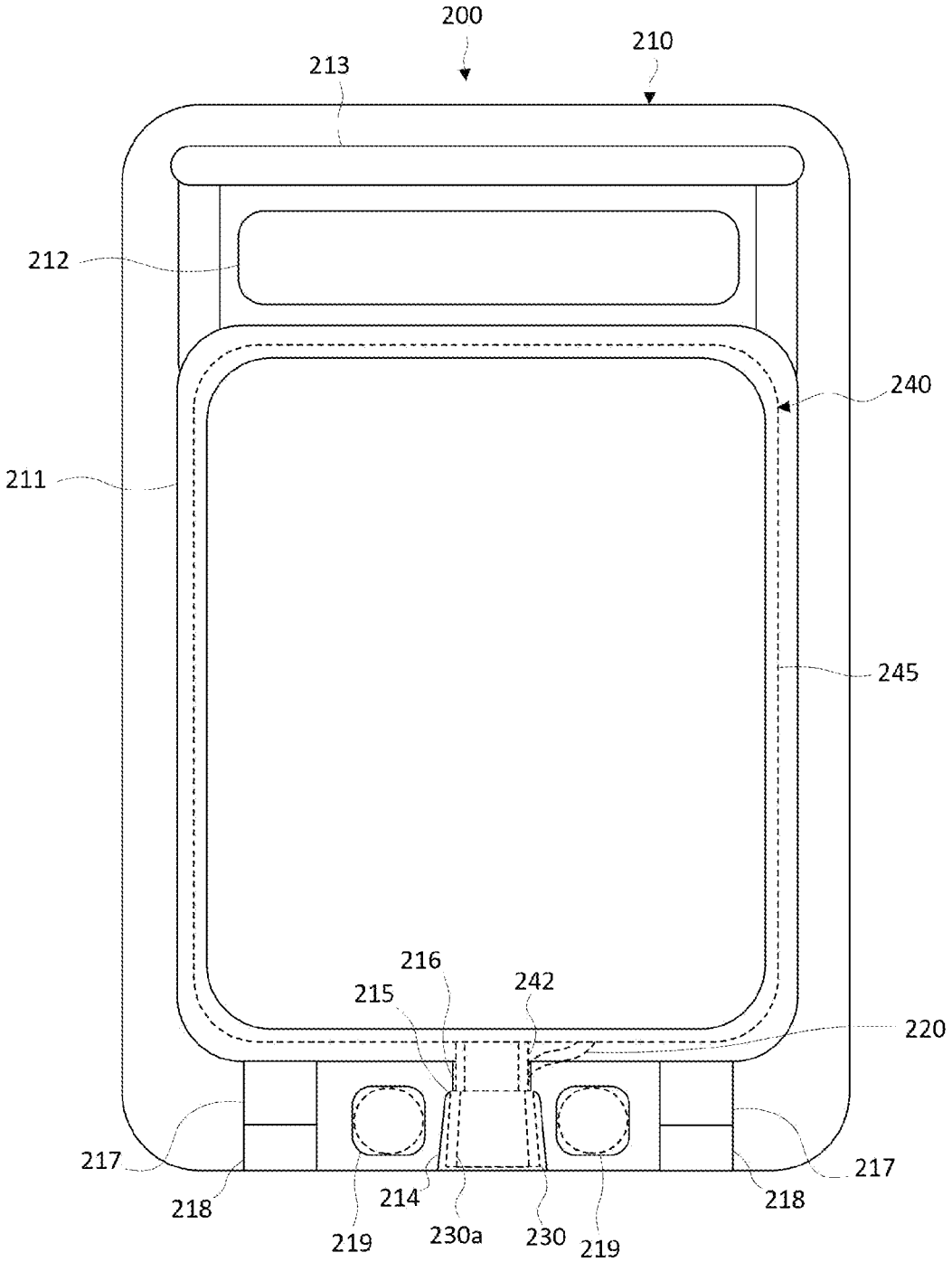
FIG. 4 is a front view of the balloon injected with gas by the gas injection apparatus.
Figure 5:
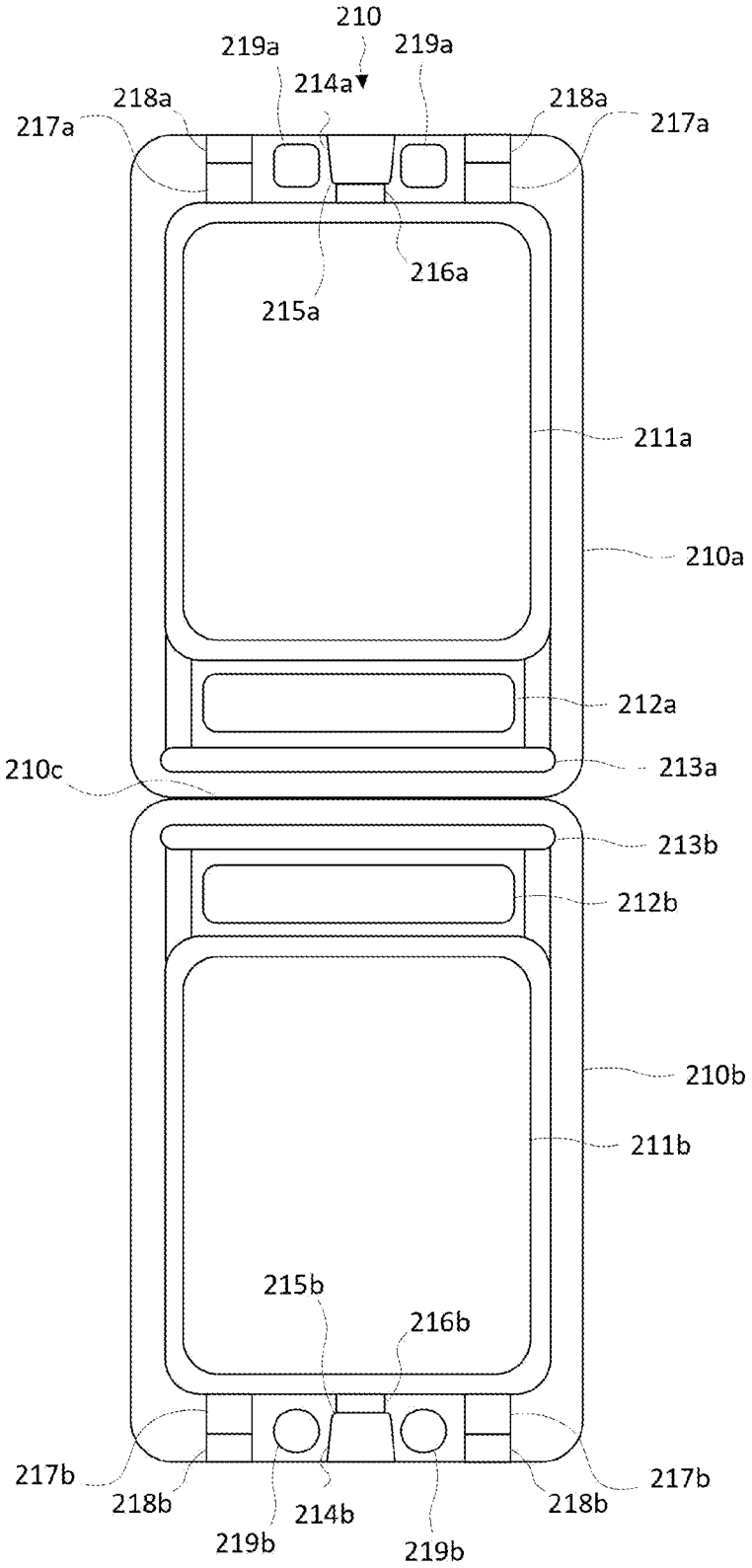
FIG. 5 is an unfold view of the balloon case.

A balloon into which gas is injected by the gas injection apparatus 100 configured as described above is described. FIG. 4 is a front view of the balloon 200 injected with gas by the gas injection apparatus 100. FIG. 5 is an unfold view of the balloon case 210. The balloon 200 comprises a balloon case 210, a string 220, a balloon valve 230 and a balloon body 240.

The balloon case 210 is formed of a transparent blister case. The balloon case 210 is integrally formed with a body housing part 211, a finger insertion part 212, a grip 213, a valve insertion part 214, a pipe insertion part 216, case piece locking parts 219, and unfold openings 217.

The body housing part 211 houses the folded balloon body 240. The finger insertion part 212 allows a finger to be inserted. The grip 213 is used to be gripped by a palm. The valve insertion part 214 is inserted through the balloon valve 230. The pipe insertion part 216 is inserted through the gas injection pipe 242. A step 215 is formed at a boundary between the valve insertion part 214 and the pipe insertion part 216.

The balloon case 210 comprises a first case piece 210*a* and a second case piece 210*b*. The balloon case 210 can house the balloon body 240 by joining the first case piece 210*a* to the second case piece 210*b* together for closing. The unfold opening 217 is formed by the unfold first facing slot 217*a* and the unfold second facing slot 217*b*. The unfold first facing slot 217*a* and the unfold second facing slot 217*b* are provided at opposite positions of the first case piece 210*a* and the second case piece 210*b* with the balloon case 210 closed. An inclined surface 218*a* and 218*b* in which the opening increases toward the open end are formed respectively in the unfold facing slots 217*a* and 217*b*.

The balloon case 210 can be opened by inserting the wedge-shaped bodies 157 into the unfold openings 217. As a result, the balloon case can be opened before the gas injection, thereby reducing the trouble at the time of the gas injection and stably performing the gas injection. The valve insertion part 214 is fixed in a state in which the balloon valve 230 is inserted when the balloon case 210 is closed.

The balloon case 210 has a first case piece 210*a* and a second case piece 210*b* which are connected to each other so as to be bendable through a central fold line 210*c*. In the first case piece 210*a*, a grip first forming part 213*a*, a finger insertion first hole part 212*a*, a body housing first forming part 211*a*, a valve insertion first forming part 214*a*, a step first forming part 215*a*, a first pipe insertion part 216*a*, a concave locking first parts 219*a*, and a unfold first facing slots 217*a* are formed. A first inclined surfaces 218*a* are formed in the unfold first facing slots 217*a*. The first inclined surface 218*a* is formed at an inclined angle that increases the opening toward the end thereof.

Further, in the second case piece 210*b*, a grip second forming part 213*b*, a finger insertion second hole part 212*b*, a body housing second forming part 211*b*, a valve insertion second forming part 214*b*, a second pipe insertion part 216*b*, a convex locking second parts 219*b* and a unfold second facing slots 217*b* are formed. A second inclined surface 218*b* is formed in the unfold second facing slot 217*b*. The second inclined surface 218*b* is formed at an inclined angle that increases the opening toward the end thereof.

The first case piece 210*a* and the second case piece 210*b* are joined to be closed, and therefore the corresponding parts of the respective case pieces are joined together as follows to form the respective parts. That is, the body housing first forming part 211*a* and the body housing second forming part 211*b* form the body housing part 211. The finger insertion first hole part 212*a* and the finger insertion second hole part 212*b* form a finger insertion part 212. The grip first forming part 213*a* and the grip second forming part 213*b* form a grip 213.

Further, the valve insertion first forming part 214*a* and the valve insertion second forming part 214*b* form the valve insertion part 214. The step first forming part 215*a* and the step second forming part 215*b* form a step 215. The first pipe insertion part 216*a* and the second pipe insertion part 216*b* form a pipe insertion part 216. The unfold first facing slot 217*a* and the unfold second facing slot 217*b* form the unfold opening 217. The first inclined surface 218*a* and the second inclined surface 218*b* form inclined surfaces 218. The locking first part 219*a* and the locking second part 219*b* form the case piece locking part 219.

As described above, the balloon case 210 comprises the valve insertion part 214 that, when the balloon case 210 is closed, locks the balloon valve 230 so that the hole of the balloon valve 230 is exposed. A step 215 is formed at a connection position between the valve insertion part 214 and the pipe insertion part 216, and the pipe insertion part 216 is formed so as to allow the pipe through but not the balloon valve 230. The balloon valve 230 pressed by the contact of the nozzle 156 is fixed by the step 215, and the nozzle 156 tightly contacts with the hole of the balloon valve 230.

The string 220 connects the balloon case 210 to the balloon body 240 and is housed in the balloon case 210 together with the balloon body 240 in a state where the balloon body 240 is housed in the balloon case 210. One end of the string 220 is connected to the balloon body 240 of the balloon 200, and the other end of the string 220 is connected to the inner surface of the body housing part 211 of the balloon case 210 housing the balloon body 240.

The balloon valve 230 is preferably made of, for example, a synthetic resin from the viewpoint of tight contact to the nozzle tip part 156*a* and lightness, and is preferably made of, for example, polyoxymethylene (POM) from the viewpoint of availability and moldability. The balloon valve 230 is fitted into and connected to the gas injection pipe 242 of the balloon body 240. Inside the balloon valve 230, a check valve is provided to prevent the injected helium gas from leaking out of the balloon body 240. The check valve may be provided in the gas injection pipe 242. Preferably, a tapered nozzle insertion part 230*a* is formed at an end part of the balloon valve 230.

The balloon body 240 is made of, for example, nylon film, and comprises a gas injection pipe 242 and an expansion part 245. The expansion part 245 is folded in a state of being housed in the balloon case 210 but is expanded by injection of gas.

Note that the balloon case 210 is not limited to a blister case. The material of the balloon body 240 is not limited to a nylon film, and the balloon body 240 may be made of another material such as an aluminum vapor deposited film, a vinyl film, or a latex film. Further, the gas for filling the balloon body 240 up to a predetermined time is not limited to helium gas. Preferably, the gas is lighter than air, but may be heavier than air depending on the application.

(Operation of Gas Injection Apparatus and Balloon)

Figure 6:
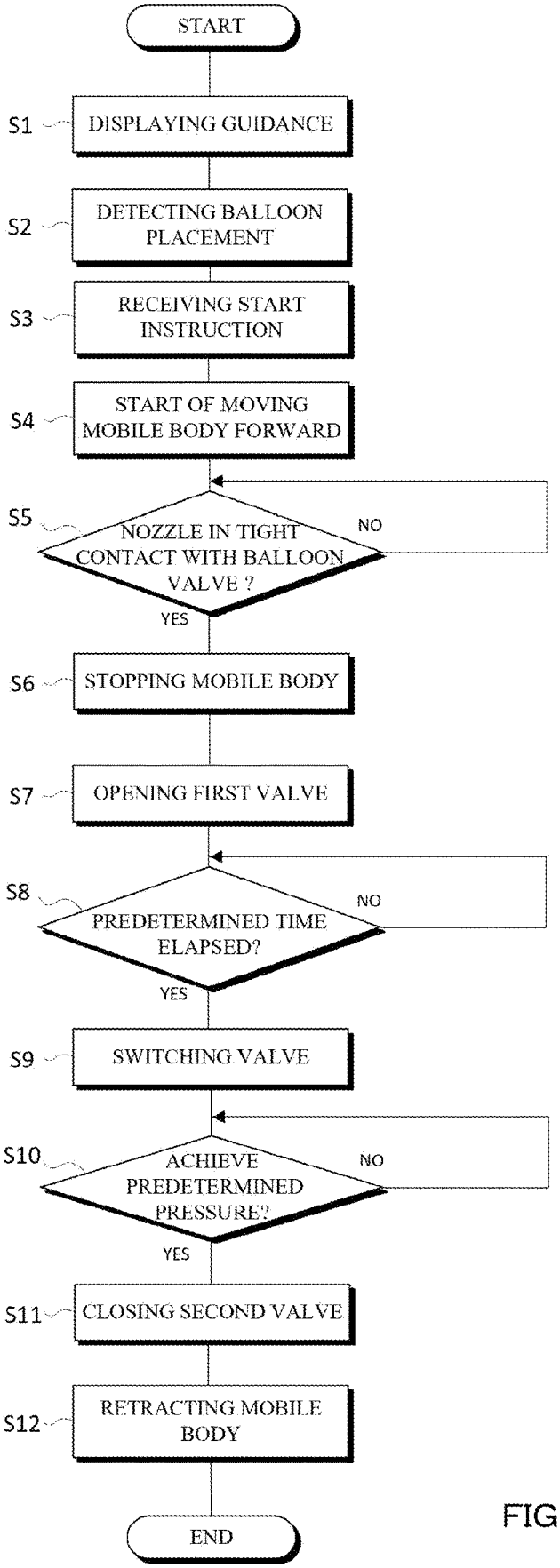
FIG. 6 is a flowchart showing an operation of the gas injection apparatus.

Next, the overall operation of the gas injection apparatus 100 is described. FIG. 6 is a flowchart showing an operation of the gas injection apparatus.

First, when the door 114 is opened by the user, the gas injection apparatus 100 performs a guidance display toward the user by the display monitor on the back wall 116 or the inclined stage 129 (step S1). The door may be opened by driving the door opening/closing motor. If the balloon 200 is placed by the user, the gas injection apparatus 100 detects the placement of the balloon 200 (step S2).

If the user presses the start button, the gas injection apparatus 100 receives a start instruction (step S3). It may be regarded that the start button is pressed by placing the balloon 200. The motor 154 is driven in response to the start instruction, and the mobile body 155 is started to move forward (step S4).

It is determined whether or not the tight contact of the nozzle 156 with the balloon valve 230 is detected (step S5), and when the tight contact is not detected, the mobile body 155 is maintained to move forward. During this time, the wedge-shaped bodies 157 contact the unfold openings 217 and the balloon case 210 is unfolded. The wedge-shaped bodies 157 move to a position adequate for the unfold of the balloon case 210, and the absence of any abnormalities is confirmed by the wedge-shaped body detector 159*a*.

On the other hand, when the nozzle setting detector 159*b* confirms the tight contact of the nozzle 156 to the balloon valve 230, the mobile body 155 is stopped (step S6). Then, the first bulb 162 is opened (step S7) and counting of elapsed times is started.

It is determined whether or not the predetermined time has elapsed (step S8), and if the predetermined time has not elapsed, the opening of the first bulb 162 is maintained. The predetermined time period is, for example, 40 seconds. The predetermined time may vary depending on the type of balloon. For example, an RFID may be embedded in the balloon case to allow the gas injection apparatus 100 to sense the type of balloon. When the predetermined time has elapsed, the valve is switched (step S9). The valve is switched by closing the first valve 162 and opening the second valve 164.

Next, the pressure inside the balloon body 240 is detected, and it is determined whether or not a predetermined pressure has been achieved (step S10). The predetermined pressure is a pressure when the balloon has been fully expanded and may be set in advance or may be a saturated pressure.

If the predetermined pressure has not been achieved, the opening of the second valve 164 is maintained. When the predetermined pressure has been achieved, the second valve 164 is closed (step S11). Then, the mobile body 155 is retracted to the original position (step S12), and the series of processes is ended.

The user can take out the balloon case 210 from the balloon case placing section 120 and take out the balloon 200 from the gas injection apparatus 100 by closing the unfolded balloon case 210 to hold the grip 213.

With such an operation, the user can have a feeling of participation in a part of the process of manufacturing the balloon and the enjoyment of manufacturing the balloon by looking at the process of injecting gas into the balloon. Next, each operation is described in detail.

(Placement of Balloon)

Figure 7:
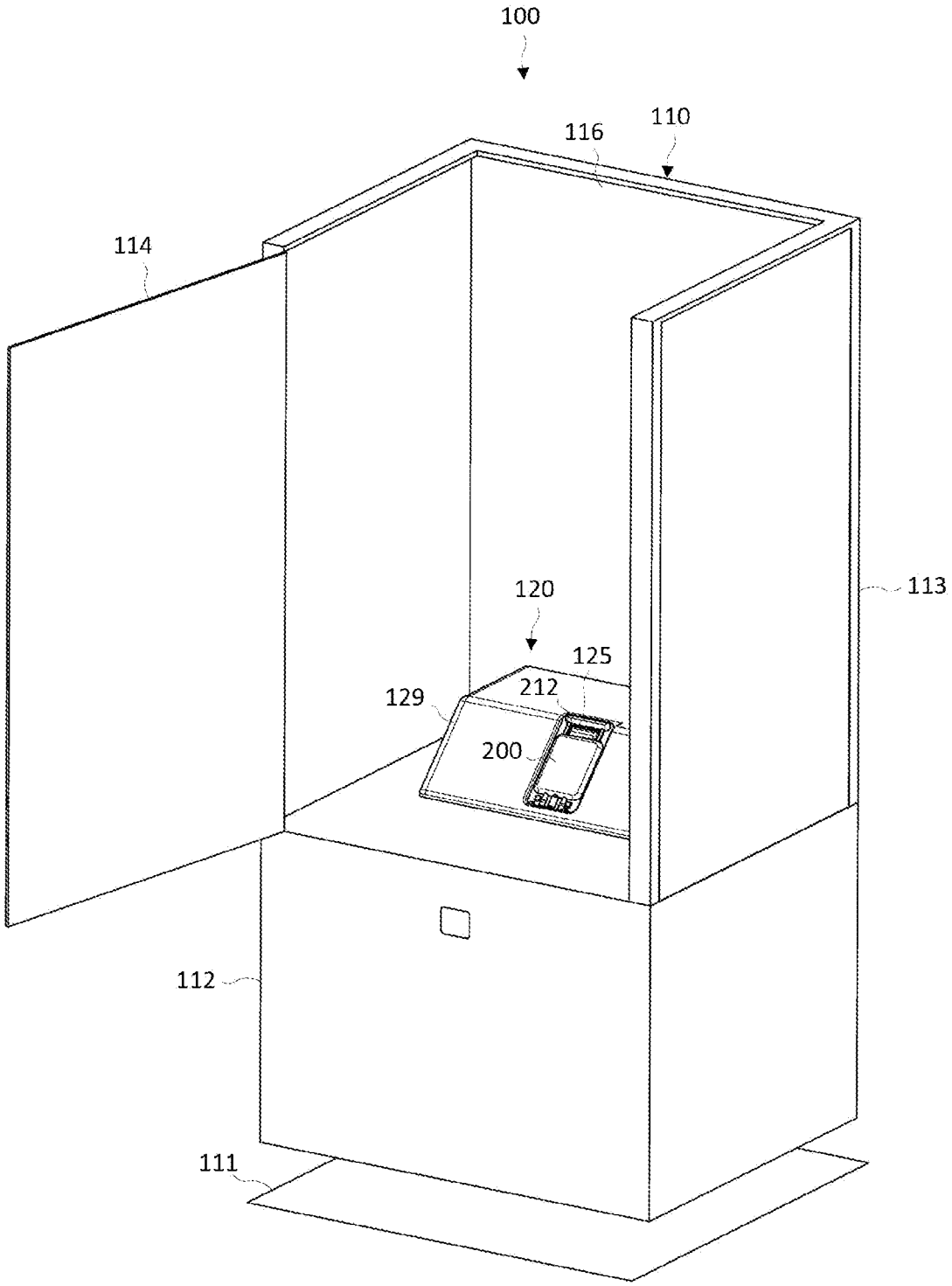
FIG. 7 is a perspective view showing a state in which the balloon is placed on the gas injection apparatus.

FIG. 7 is a perspective view showing a state in which the balloon is placed on the gas injection apparatus. As shown in FIG. 7, the user can insert the projection part 125 into the finger insertion part 212 of the balloon case and fit the balloon 200 into the recess of the balloon case placing section 120. As a result, the balloon 200 can be placed by bringing one surface of the balloon 200 into tight contact with the bottom surface of the balloon case placing section 120.

(Unfold of Balloon Case)

Figure 8A:
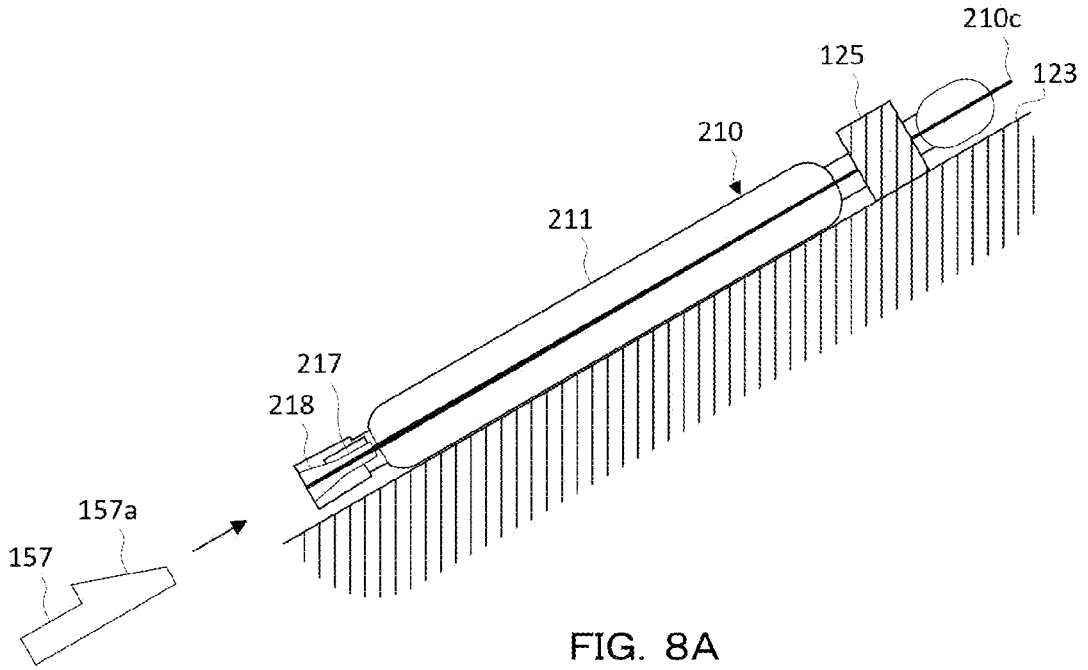
FIGS. 8A and 8B are cross-sectional views showing a state in which the wedge-shaped bodies move toward the balloon case and a state in which the wedge-shaped bodies are inserted, and the balloon case is unfold, respectively.
Figure 8B:
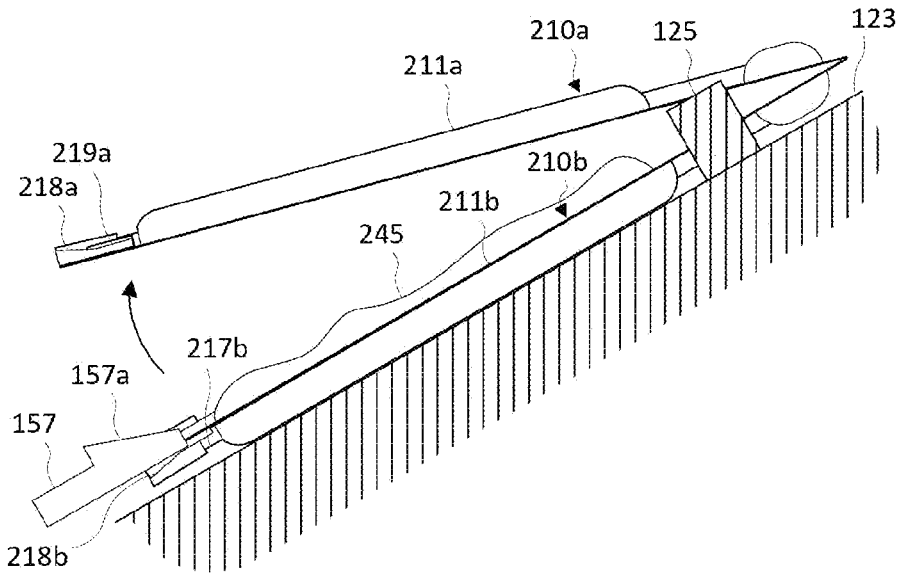

FIGS. 8A and 8B are cross-sectional views showing a state in which the wedge-shaped bodies 157 move toward the balloon case 210 and a state in which the wedge-shaped bodies 157 are inserted and the balloon case 210 is unfold, respectively. Both cross-sectional views show vertical cross-sections of the central of the wedge-shaped body 157 and the unfold opening 217.

As shown in 8A, when the mobile body 155 is driven, the wedge-shaped bodies 157 move toward the unfold openings 217. Then, the inclined surface of the wedge-shaped body tip parts 157*a* contact the inclined surfaces 218 of the unfold openings 217, thereby pressing the first case piece 210*a* and the second case piece 210*b* away from each other. Then, the locking first part 219*a* is disengaged from the locking second part 219*b*, the locking of the case piece locking part 219 is released. Accordingly, the first case piece 210*a* and the second case piece 210*b* of the balloon case 210 are opened so as to be split around the central fold line 210*c*.

As a result, as shown in FIG. 8B, the balloon body 240 is exposed by the unfold of the balloon case, and the expansion of the balloon body 240 due to the gas injection is not hindered. In this way, the balloon case is always opened without being influenced by the manner in which the balloon 200 is placed or the gas pressure. Then, it is possible to reduce the trouble at the time of the gas injection.

(Nozzle Insertion and Gas Injection)

Figure 9A:
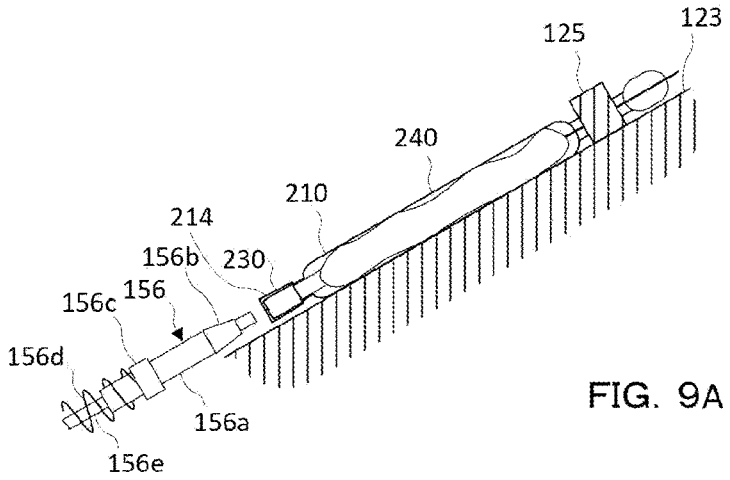
FIGS. 9A to 9C are a cross-sectional view showing a state in which the nozzle is moved toward the balloon, a state in which the nozzle is inserted into the balloon valve and a state in which the gas is injected into the balloon body.
Figure 9B:
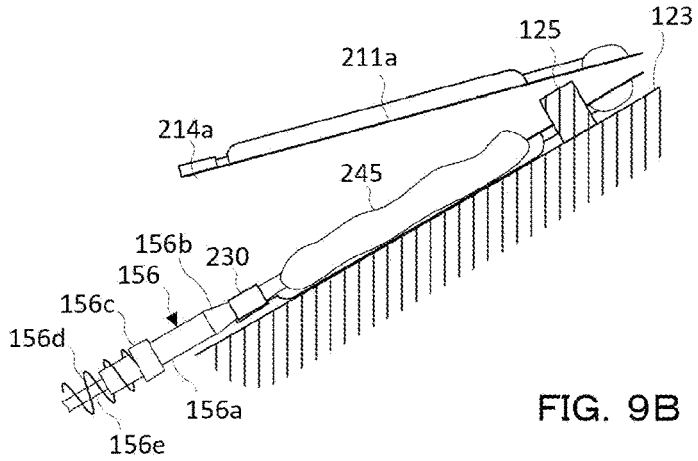
Figure 9C:
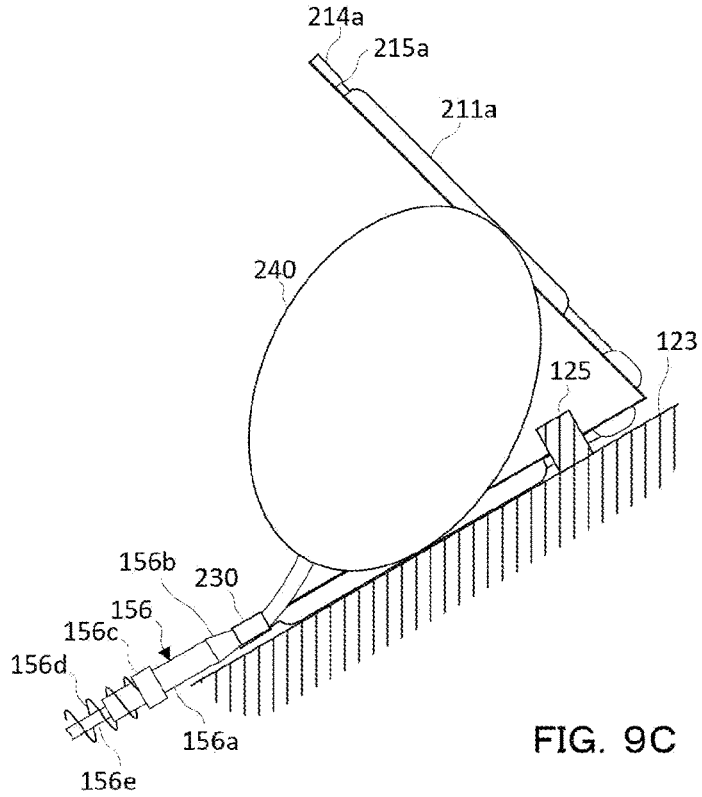

FIGS. 9A to 9C is a cross-sectional view showing a state in which a nozzle is moved toward a balloon, a state in which a nozzle is inserted into a balloon valve, and a state in which a gas is injected into a balloon body. Both cross-sectional views show a vertical cross-section of the central of the nozzle 156 and the valve insertion part 214.

As shown in FIG. 9A, when the mobile body 155 is actuated, the nozzle 156 advances toward the balloon valve 230. Then, as shown in FIG. 9B, the convergent slope 156*b* of the nozzle tip part 156*a* contacts the inner wall of the resin pipe part of the balloon valve 230. At this time, the balloon case 210 has already been unfolded by the wedge-shaped bodies 157.

Since the nozzle tip part 156*a* is formed of a rubbery body, the nozzle tip part 156*a* and the balloon valve 230 come into tight contact with each other, so that a gap between the nozzle tip part and the balloon valve is eliminated, and the gas injection path is sealed. At this time, since the nozzle tip part 156*a* can release the force by the slide mechanism while receiving the pressing force from the spring 156*d*, the balloon valve 230 is not subjected to a force of a certain value or more.

In this condition, the nozzle setting detector 159*b* detects that the nozzle 156 has reached a predetermined position. As a result, the forward rotation of the rotary shaft is stopped, and the mobile body 155 is stopped. In this way, it is confirmed by the nozzle setting detector 159*b* that the nozzle 156 is in tight contact with the balloon valve 230, and the injection of the gases is started. Then, as shown in FIG. 9C, helium gas is injected into the balloon body 240 from the nozzle 156, and the balloon body 240 gradually expands.

When a predetermined amount of helium gas is injected into the balloon body 240 and a predetermined time has elapsed, the first valve 162 is closed, the second valve 164 is opened, and the gas inflow path is switched. Atmospheric air is then sucked in by the air compressor and injected into the balloon body 240. When the balloon body 240 expands spherically, the pressure sensor senses a predetermined pressure to stop the injection of the atmosphere. The gas in the balloon body 240 is a mixed gas mostly of helium gas and slightly added with the atmosphere and provides buoyancy to the balloon body 240 in the atmosphere.

The expanded balloon body 240 begins to fly away from the balloon case 210. The user can see new and impactful scene in which the balloon case 210 dynamically splits, the balloon body 240 expands and flies from the balloon case 210.

When the gas injection is completed, the nozzle 156 starts to move to the side opposite to the balloon case 210 due to the reverse rotation of the rotary shaft. Therefore, the balloon valve 230 contacts the front wall 123*b*, and the balloon valve 230 cannot move and the nozzle 156 comes off the balloon valve 230.

The projection part 125 fits into the finger insertion second hole part 212*b* of the second case piece 210*b*, and the user can immediately grasp the balloon case 210. The balloon body 240 goes up by helium gas but is prevented from flying higher by the string 220 connected to the balloon case 210. The mobile body 155 detects that the nozzle has moved to the original retraction position by the nozzle retraction detector 159*c*, so that the rotation of the rotary shaft is stopped and the mobile body 155 is also stopped.

(After Completion of Injection)

Figure 10A:
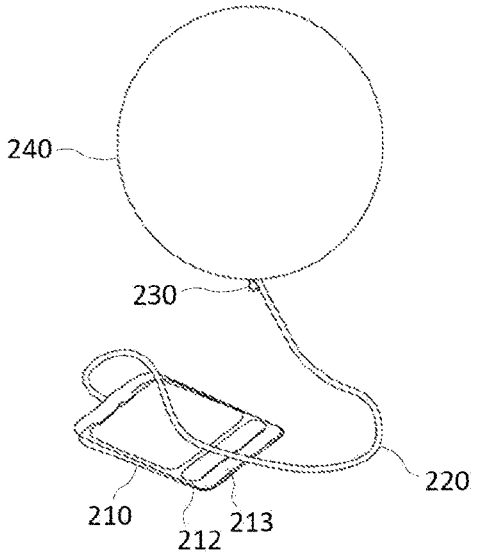
FIGS. 10A and 10B are a schematic view showing a state in which the balloon case is taken out after expansion of the balloon body and a state in which the grip of the balloon case is gripped, respectively.
Figure 10B:
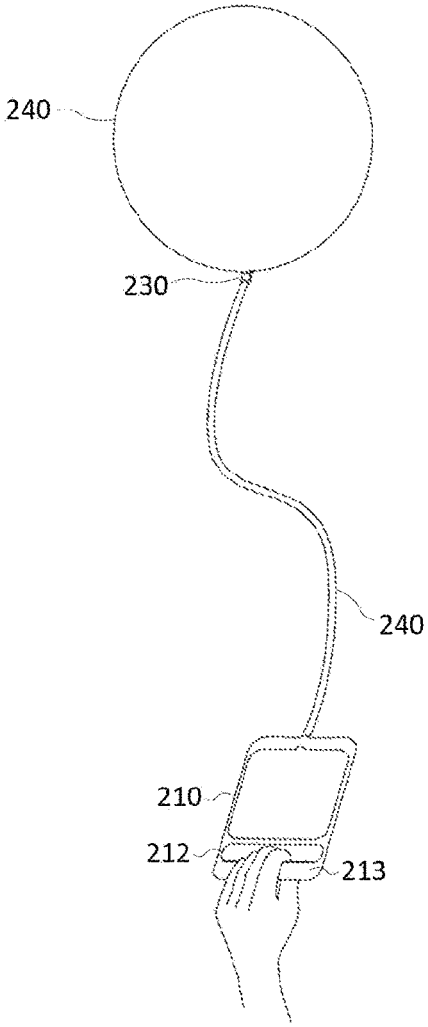

FIGS. 10A and 10B are a schematic view showing a state in which the balloon case 210 is taken out after expansion of the balloon body 240 and a state in which the grip 213 of the balloon case 210 is gripped, respectively. As shown in FIG. 10A, the extracted balloon case 210 remains unfolded, and the user can close the opened first case piece 210*a* and the second case piece 210*b* to fit the locking first part 219*a* to the locking second part 219*b* to close the balloon case 210.

The user can reuse the balloon case 210 as a gripping member. As a result, the balloon case 210 is not discarded as dust. In addition, it is possible to reduce the time and cost for installing the trash box for discarding the balloon case 210 in the vicinity of the gas injection apparatus 100.

As shown in FIG. 10B, fingers can be passed through the finger insertion part 212 of the closed balloon case 210 to grip the grip 213. When the user extracts the balloon 200 from the gas injection apparatus 100, the door motor is reversely rotated and the door 114 is closed. In this way, the gas injection apparatus 100 and balloon 200 are provided that are less prone to failure due to the manner in which the balloon is placed in the apparatus.

DESCRIPTION OF SYMBOLS

100 gas injection apparatus
110 housing
111 base
112 mechanism housing section
113 gas injection chamber
114 door
116 wall
120 balloon case placing section
123 bottom surface
123*a* side wall
123*b* front wall
123*c* hole (front wall)
123*d* guide wall
123*e* hole (guide wall)
125 projection part
127 placing base part
129 inclined stage
130 power plug
140 control unit
141 DC transducer
145 control board
147 I/O interface
150 gas injection mechanism
151 balloon case detector
151 and 152 balloon case detector
152 balloon case detector
153 LED board
154 motor
155 mobile body
156 nozzle
156*a* nozzle tip part
156*b* slope
156*d* spring
156*e* straight pipe
157 wedge-shaped body
157*a* wedge-shaped body tip part
158 mobile body base part
159*a* wedge-shaped body detector
159*b* nozzle setting detector
159*c* nozzle retraction detector
160 gas flow path mechanism
161*a* gas bomb
161*b* regulator
165 flow path integrating section
166 total flowmeter
167 relief valve
168 relief flowmeter
169 gas hose
200 balloon
210 balloon case
210*a* first case piece
210*b* second case piece
210*c* central fold line
211 body housing part
211*a* body housing first forming part
211*b* body housing second forming part
212 finger insertion part
212*a* finger insertion first hole part
212*b* finger insertion second hole part
213 grip
213*a* grip first forming part
213*b* grip second forming part
214 valve insertion part
214*a* valve insertion first forming part
214*b* valve insertion second forming part
215 step
215*a* first forming part of step
215*b* second forming part of step
216 pipe insertion part
216*a* first pipe insertion part
216*b* second pipe insertion part
217 unfold opening
217*a* unfold first facing slot
217*b* unfold second facing slot
218 inclined surface
218*a* first inclined surface
218*b* second inclined surface
219 case piece locking part
219*a* locking first part
219*b* locking second part
220 string
230 balloon valve
230*a* nozzle insertion part
240 balloon body
242 gas injection pipe
245 expansion part

What is claimed is:

1. A gas injection apparatus for injecting gas into a balloon body from a balloon valve connected to a gas injection pipe of the balloon body, the gas injection apparatus comprising:

a nozzle configured to be inserted into the balloon valve and to inject gas into the balloon body;

a valve mechanism configured to open and close a gas flow path to the nozzle;

a drive mechanism configured to move the nozzle forward and backward;

a balloon case including a first case piece and a second case piece connected to be bendable, and including an unfold opening formed by opposing slots provided in the first case piece and the second case piece in a closed state;

a balloon case placing section having a flat bottom surface on which the balloon case housing the balloon body and including the balloon valve is placeable, the balloon case placing section being configured to position the balloon valve such that an open end of the balloon valve faces a forward movement direction of the nozzle;

a projection part provided on the flat bottom surface of the balloon case placing section and configured to engage with a finger insertion part formed in the balloon case to fix a position of the balloon case on the balloon case placing section;

wedge-shaped bodies configured to move in conjunction with the nozzle by the drive mechanism and to be inserted into the unfold opening to open the balloon case; and a control unit configured to control the drive mechanism and the valve mechanism, wherein the control unit is configured to:

move the nozzle forward in response to a start instruction, insert the nozzle into the balloon valve to bring the nozzle and the balloon valve into tight contact without clearance, and inject gas into the balloon body while maintaining the tight contact.

2. The gas injection apparatus according to claim 1, wherein an opening of the balloon valve is formed in a resin pipe, and a tip portion of the nozzle is formed of a rubber-like material and has a tapered shape.

3. The gas injection apparatus according to claim 2, wherein an elastic member for restricting movement of the tip portion of the nozzle is provided.

4. The gas injection apparatus according to claim 1, further comprising:

a gas injection mechanism, wherein the gas injection mechanism is configured to supply a first gas and a second gas having different pressures, the gas injection mechanism includes:

a first gas flow path connected to a first gas supply source and communicating with the nozzle;

a first valve provided in the first gas flow path and configured to control a flow of the first gas;

a second gas flow path formed between a second gas supply source and a flow path integrating section, and connected to the first gas flow path at the flow path integrating section; and a second valve provided in the second gas flow path and configured to control a flow of the second gas, wherein the control unit is configured to:

operate the first valve to inject the first gas at a first pressure for a predetermined time, close the first valve, and thereafter operate the second valve to inject the second gas at a second pressure lower than the first pressure.

* * * * *